US005383253A

United States Patent [19]

Lin

[11] Patent Number: 5,383,253

[45] Date of Patent: Jan. 24, 1995

[54] HYDRAULIC BUFFER HINGE

[76] Inventor: Yeon-Yu Lin, 161, Chi Mei Street, San Chung Shih, Taipei Hsien, Taiwan, Prov. of China

[21] Appl. No.: 879,284

[22] Filed: May 7, 1992

[51] Int. Cl.[6] ..... E05F 3/20; E05F 1/12

[52] U.S. Cl. ..... 16/54; 16/50; 16/76; 16/299; 16/300; 16/301; 16/307; 16/82

[58] Field of Search ..... 16/50, 54, 68, 51, 57–59, 16/66, 319, 76, 82, 299–301, 307

[56] References Cited

U.S. PATENT DOCUMENTS

| | | | |
|---|---|---|---|
| 1,823,263 | 9/1931 | Fabry | 16/54 |
| 4,103,392 | 8/1978 | MacDonald | 16/54 |
| 4,485,522 | 12/1984 | Chen | 16/54 |
| 4,583,262 | 4/1986 | Werner | 16/300 |
| 4,756,051 | 7/1988 | Shy | 16/54 |
| 4,825,503 | 5/1989 | Shiramasa et al. | 16/76 |

FOREIGN PATENT DOCUMENTS

| | | | |
|---|---|---|---|
| 1244614 | 7/1967 | Germany | 16/300 |
| 52-4961 | 7/1977 | Japan | 16/50 |

*Primary Examiner*—W. Donald Bray
*Assistant Examiner*—Donald M. Gurley
*Attorney, Agent, or Firm*—Bacon & Thomas

[57] ABSTRACT

A hydraulic buffer hinge for a door comprising a hydraulic buffer mechanism having a piston and a piston rod supported on a spring and received inside a hydraulic oil container to slowing down the return stroke of two swinging plates when the door, onto which the swinging plates are fastened, is closed.

5 Claims, 7 Drawing Sheets

HYDRAULIC BUFFER HINGE

BACKGROUND OF THE INVENTION

The present invention relates to hinges, and more particularly, the present invention relates to a hydraulic buffer hinge used to connect a swinging door to a door frame permitting the swinging door which has a hydraulic buffer mechanism to slow down the return movement of the swinging door.

A variety of hinges are known and widely used in fastening swinging doors in place. By means of the arrangement of a hinge or hinges, a swinging door is allowed to return automatically each time after it has been opened. The common disadvantage of the conventional hinges is that a load sound of impact is produced each time a swinging door is automatically closed. This problem happens because there is no any buffer means to slow down the return stroke of the swinging door.

SUMMARY OF THE INVENTION

The present invention has been accomplished to eliminate the aforesaid problem. It is therefore an object of the present invention to provide a hydraulic buffer hinge which has a hydraulic buffer mechanism to slow down the return stroke of the swinging door connected thereto. It is another object of the present invention to provide a hydraulic buffer hinge which has a locating mechanism to releasably stop a door in an opened position.

DETAILED DESCRIPTION OF THE PREFERRED EMBODIMENT

Figure 1:
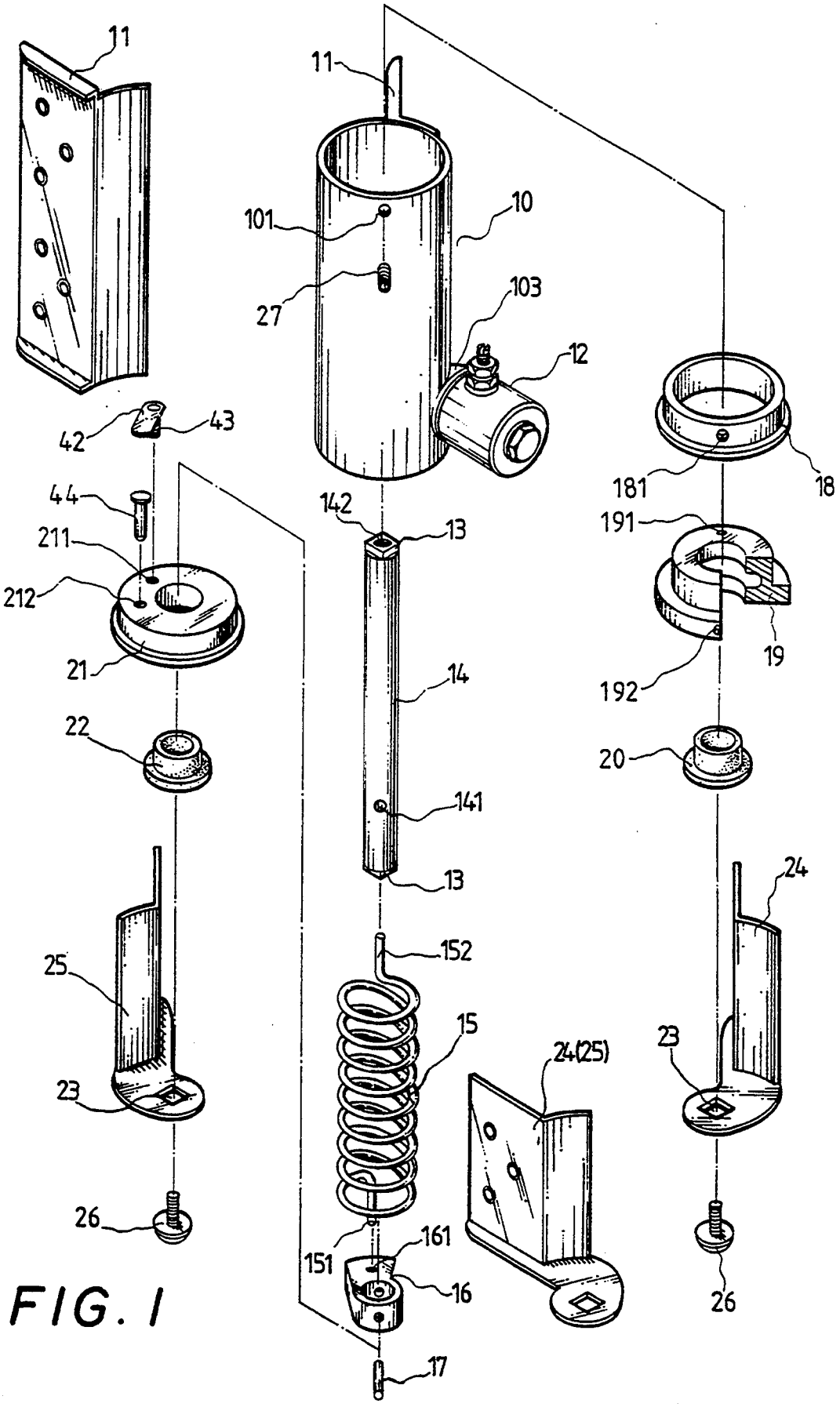
FIG. 1 is an exploded view of the preferred embodiment of the present invention.
Figure 2:
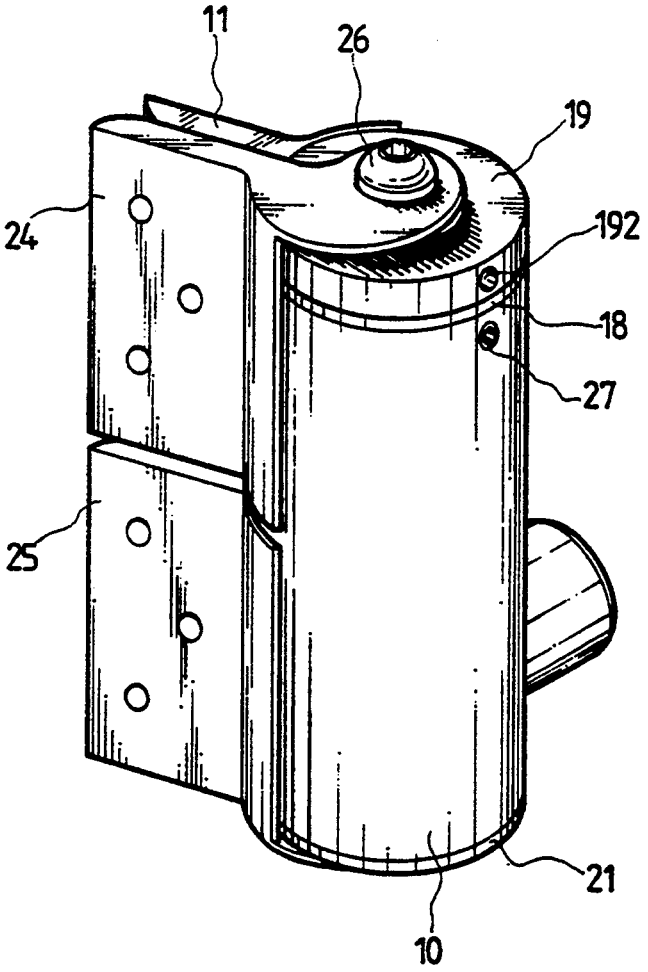
FIG. 2 is an elevational view thereof.
Figure 3:
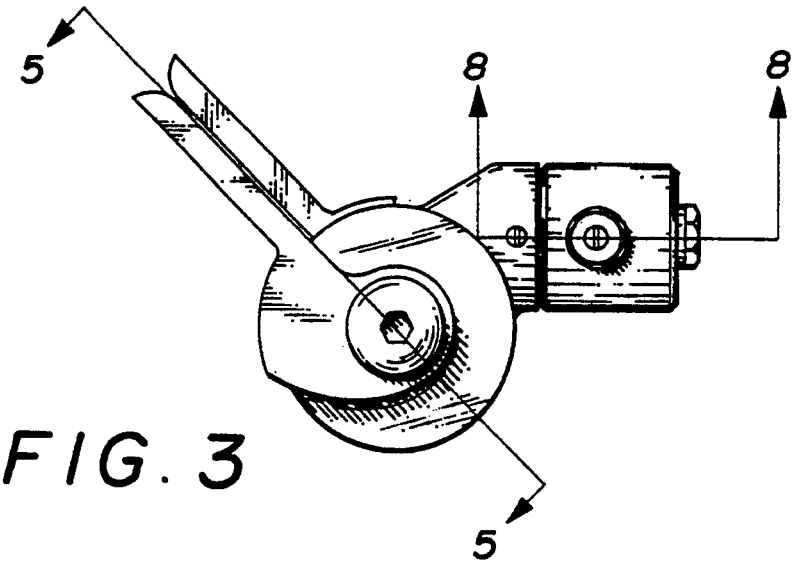
FIG. 3 is a top view thereof.
Figure 4:
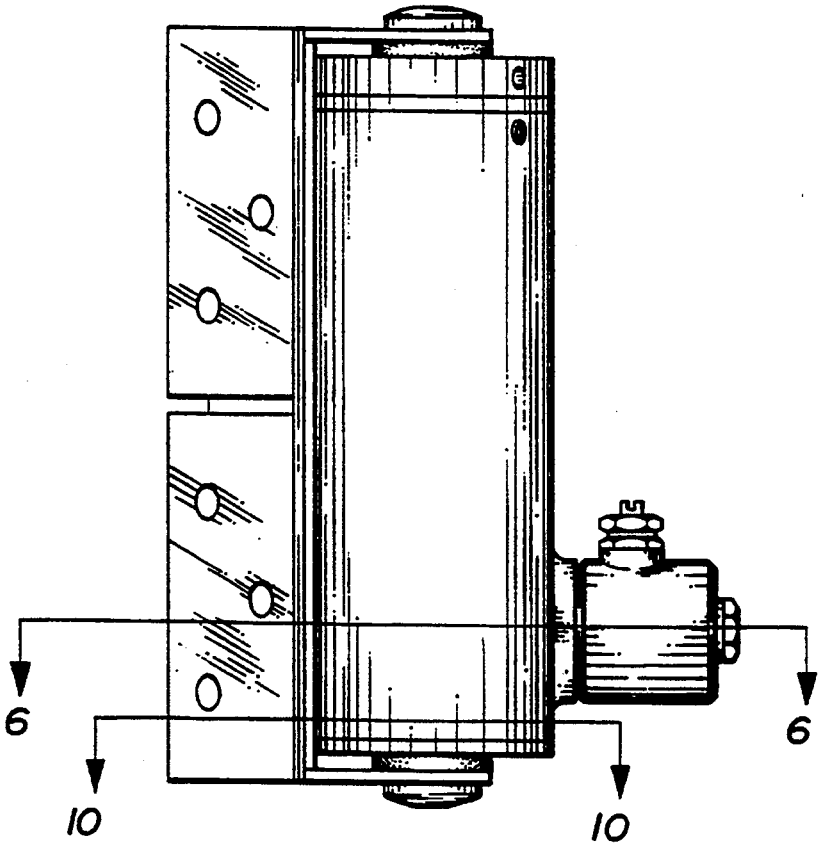
FIG. 4 is a front view thereof.

Referring to FIGS. 1 and 2, the preferred embodiment of the hydraulic buffer hinge of the present invention comprises a hollow cylindrical casing 10 having a mounting plate 11 longitudinally welded to the peripheral outside surface thereof and a hydraulic buffer 12 on the outside near the bottom end thereof. A shaft 14 which has two square nuts 13 at the two opposite ends thereof is inserted through a compression spring 15 and a stop plate 16, that are respectively held inside the hollow cylindrical casing 10. The stop plate 16 is sleeved on the shaft 14 and secured in place by a lock pin 17, which is inserted through a hole 141 on the shaft 14. An upper bush 18, an adjusting ring 19 and a cushion ring 20 are respectively sleeved on the shaft 14 and secured at the top of the cylindrical casing 10 by an upper swinging plate 24 and a screw 26. A lower bush 21 and a cushion ring 22 are respectively sleeved on the shaft 14 and secured at the bottom of the cylindrical casing 10 by a lower swinging plate 25 and a screw 26. The compression spring 15 has a bottom end 151 inserted in a hole 161 on the stop plate 16, and a top end 152 inserted in a hole 191 on the adjusting ring 19. The upper and lower swinging plates 24,25 each have a square hole 23, through which the two screws 26 are respectively threaded into the threaded holes 142 on the square nuts 13 at the two opposite ends of the shaft 14, and therefore the upper and lower swinging plates 24,25 rotate with the shaft 14. The cylindrical casing 10 has a bolt hole 101 on the peripheral wall near the top end thereof corresponding to a bolt hole 181 on the upper bush 18, into which a tightening up screw 27 is threaded to stop against the adjusting ring 19. The tension of the compression spring 15 is adjusted by adjusting the adjusting ring 19. The adjusting ring 19 has an adjusting hole 192 on its peripheral outside wall. By loosening the tightening up screw 27, and then inserting a pointed object into the adjusting hole 192 and rotating it, the tension of the compression spring 15 is adjusted.

Figure 5:
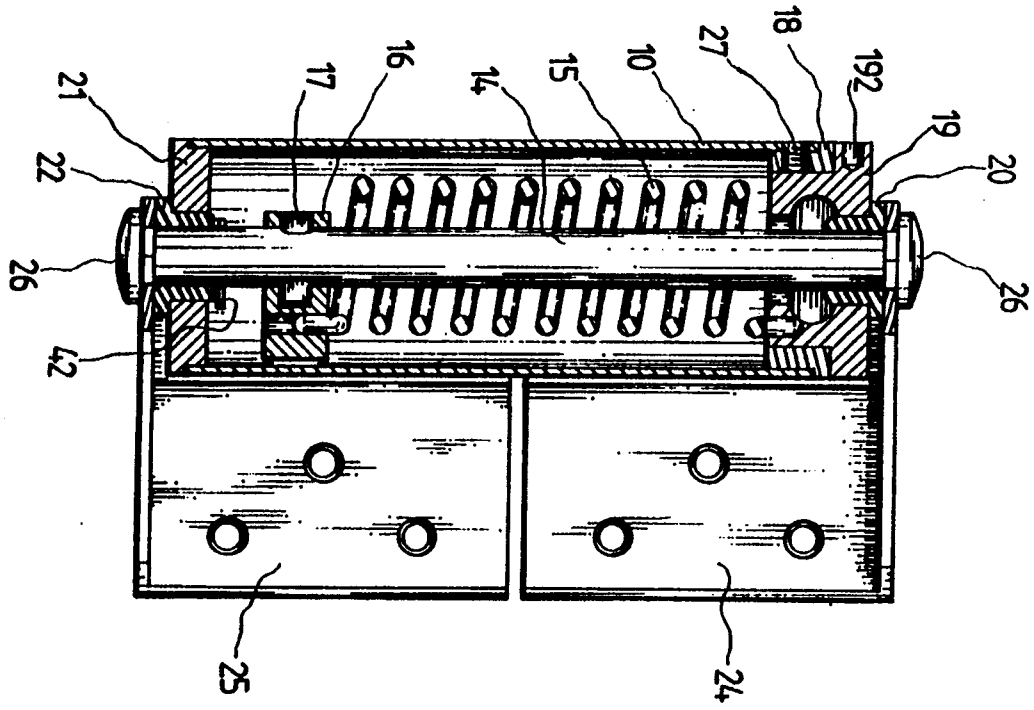
FIG. 5 is a cross section taken on line 5—5 of FIG. 3.
Figure 6:
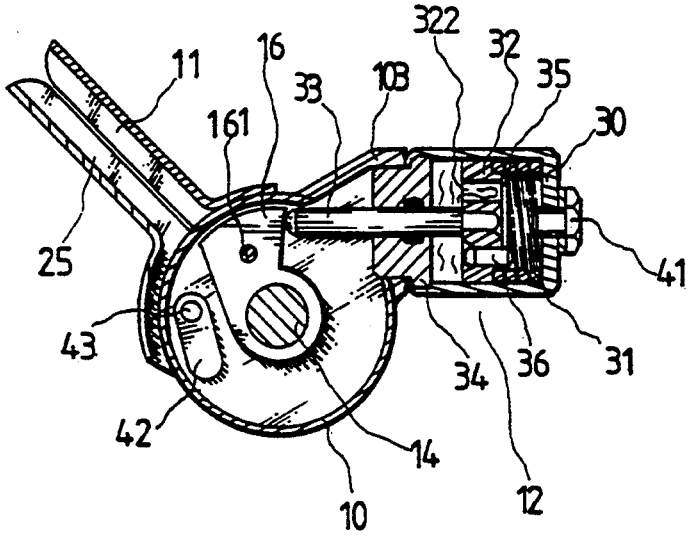
FIG. 6 is a cross section taken on line 6—6 of FIG. 4, showing the positions of the hydraulic buffer mechanism and the stop plate.
Figure 7:
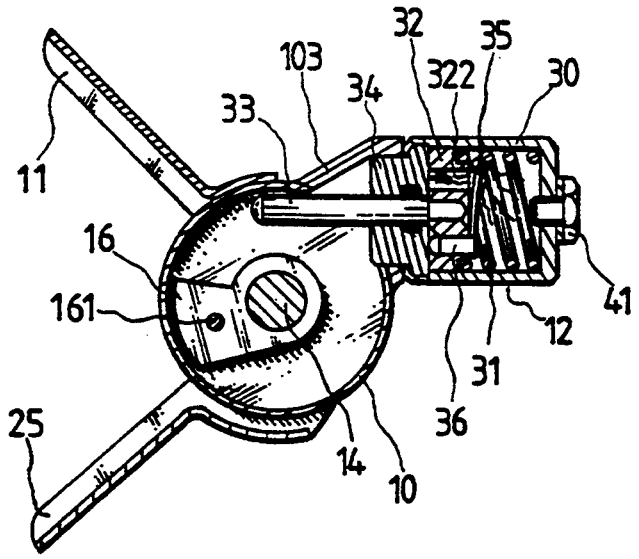
FIG. 7 is a cross section taken on line 6—6 of FIG. 4, showing the operation of the hydraulic buffer mechanism.

Referring to FIGS. 5, 6 and 7, rotating the upper and lower swinging plates 24,25 causes the shaft 14 and the stop plate 16 to rotate. A hydraulic buffer mechanism is formed by matching the rotary motion of the stop plate 16 with the hydraulic buffer 12. The hydraulic buffer 12 is comprised of a cylindrical container 30, a spring 31, a piston 32, a piston rod 33, and a cap 34. The piston rod 33 and the piston 32 are made in a unitary piece and inserted with the spring 31 into the holding space inside the container 30. The cap 34 is covered on an opening (not shown) of the container, and has a hole (not shown) for passing the piston rod 33. The cylindrical casing 10 has a hollow cylindrical connector 103 welded to the outside wall thereof. The cap 34 of the hydraulic buffer 12 has one end inserted into the hollow cylindrical connector 103 and secured in place by screw bolts 46. Therefore, the hydraulic buffer 12 is connected to the cylindrical casing 10.

Figure 8:
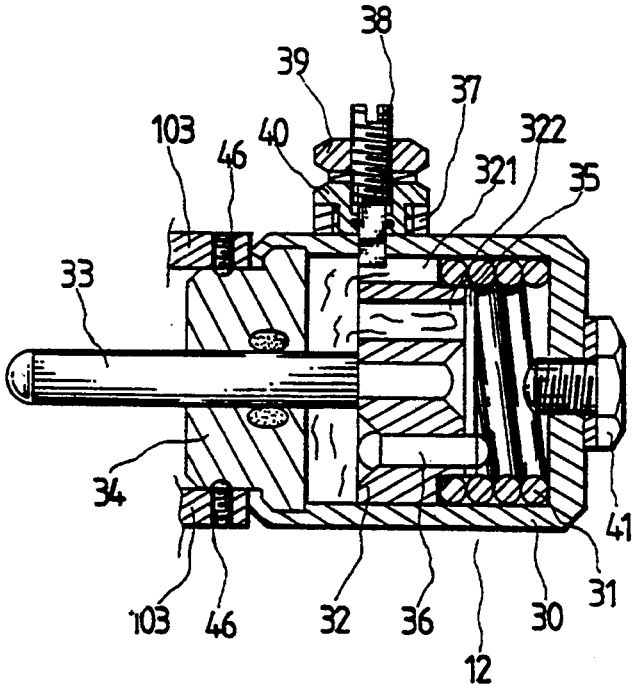
FIG. 8 is a cross section taken on line 8—8 of FIG. 3, showing the internal structure of the hydraulic buffer mechanism.
Figure 8A:
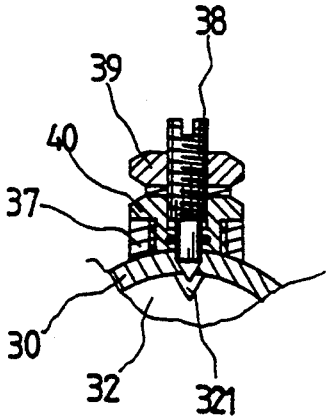
FIG. 8A is a partial sectional view showing the screw rod for adjusting the flow rate of the hydraulic oil through the guiding groove.
Figure 9:
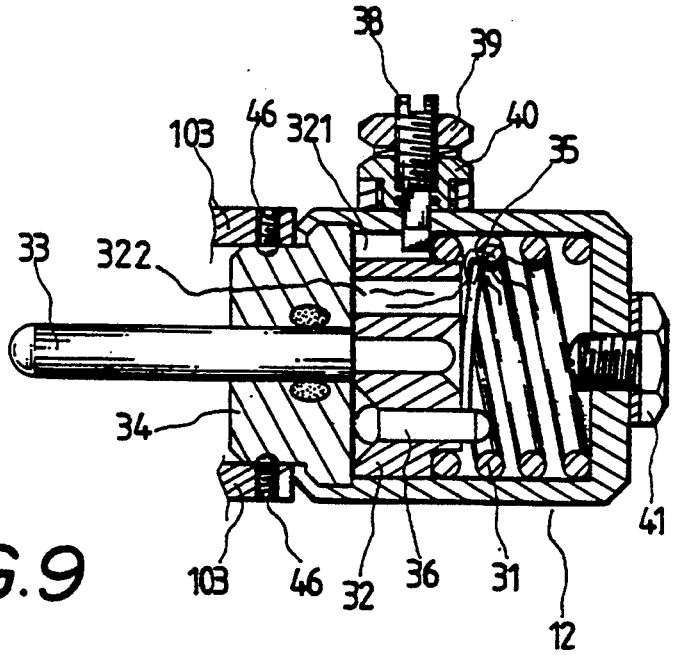
FIG. 9 is a cross section taken on line 8—8 of FIG. 3, showing the return flow of hydraulic oil.

Referring to FIGS. 8 and 9, the piston 32 has a guiding groove 321 and an oil passage hole 322 respectively formed on the side wall and the top end thereof for passing a hydraulic oil. The oil passage hole 322 is covered by a spring plate 35, which is fastened to the piston 32 by a pin 36. Because of the arrangement of the spring plate 35, a hydraulic oil is allowed to pass through the oil passage hole 322 in one direction (see FIGS. 7 and 9). When the upper and lower swinging plates 24,25 are rotated (the door is opened), the shaft 14 and the stop plate 16 are simultaneously carried to rotate, causing the stop plate 16 to move away from the piston rod 33. Once the piston rod 33 has been released from the constraint of the stop plate 16, the spring 31 immediately pushes the piston rod 33 outwards thus permitting the hydraulic oil to flow from the front space through the guiding groove 321 and the oil passage hole 322 into the rear space (where the spring 31 is located), and therefore the piston 32 as well as the piston rod 33 are moved formed at a certain distance. When the upper and lower swinging plates 24,25 return to their original positions during closing of the door, the stop plate 16 is moved back to its original position and engages the piston rod 33 and the piston 32 which in turn slows down the speed of the closing door. Because the hydraulic oil is permitted to flow from the rear space to the front space through the guiding groove 321, the moving speed of the piston 32 and the piston rod 33 is relatively slower in its return stroke than in its forward stroke. During the return stroke of the piston 32 and the piston rod 33, the spring 31 also provides a resisting force to slow down the return stroke of the piston 32 and the piston rod 33. The container 30 has a female screw 37 welded to the outside wall thereof, into which a screw rod 38 is threaded and locked in place by locknuts 39,40. The screw rod 38 has a bottom end inserted in the guiding groove 321. By screwing the screw rod 38 upwards or downwards on the female screw 37, the flow rate of the hydraulic oil through the guiding groove 321 is adjusted. The container 30 further comprises a oil feeding hole (not shown) locked by a screw 41, through which a hydraulic oil can be filled into the container 30. Oil seal rings may be fastened to any moving parts of the hydraulic buffer 12 to seal the gaps.

Figure 10:
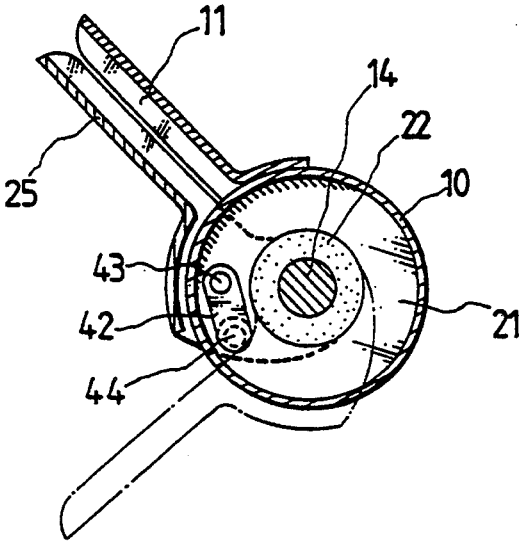
FIG. 10 is a cross section taken on line 10—10 of FIG. 4, showing the operation of the limit mechanism.

Referring to FIG. 10 and seeing FIG. 1 again, the lower bush 21 has a bolt hole 211 and a through hole 212 through the body thereof, into which a screw 43 and a stop element 44 are respectively inserted. The screw 43 has a head coupled with a spring plate 42, which is covered over the stop element 44. The length of the stop element 44 is relatively longer than the thickness of the lower bush 21. When assembled, the bottom end of the stop element 44 is extended out of the bottom edge of the lower bush 21. Therefore, when the upper and lower swinging plates 24,25 are rotated to open a door, the door can be retained opened by engaging the stop element 44 against the bottom portion of the lower swinging plate 25. This forms a locating mechanism for maintaining the lower swing plate 25 at a location spaced from the mounting plate 11. Because the stop element 44 has a top end engaging at the spring plate 42, it can be moved from the lower swinging plate 25 when the door is pushed back.

What is claimed is:

1. A hydraulic buffer hinge for a door comprising a hollow cylindrical casing, a mounting plate welded to said cylindrical casing on the outside thereof, a hydraulic buffer connected to said cylindrical casing adjacent a bottom end thereof, a shaft inserted through said cylindrical casing, said shaft having two square nuts at two opposite ends thereof, an upper bush, a spring tension adjusting ring and an upper cushion ring respectively received on said shaft and secured to said cylindrical casing at a top end thereof, a stop plate, a lower bush and a lower cushion ring respectively received on said shaft and secured to said cylindrical casing at the bottom end thereof, a compression spring sleeved on said shaft and received inside said cylindrical casing, said compression spring having a bottom end connected to said stop plate and a top end connected to said spring tension adjusting ring, an upper swinging plate and a lower swinging plate respectively connected to the two square nuts of said shaft by screws, a locating mechanism for maintaining the lower swinging plate at a location spaced from said mounting plate, wherein said upper and lower swinging plates are rotated on said cylindrical casing relative to said mounting plate as said door is opened or closed, and said stop plate engages the hydraulic buffer to form a hydraulic buffer mechanism for slowing down the moving speed of said upper and lower swinging plates during closing of the door.

2. The hydraulic buffer hinge according to claim 1, wherein said cylindrical casing has a bolt hole aligned with a bolt hole on said upper bush, into which bolt holes a tightening up screw is threaded to engage against said spring tension adjusting ring, said spring tension adjusting ring having an adjusting hole on a peripheral wall thereof for receiving a pointed object to rotate the adjusting ring and adjust the tension of said compression spring after said tightening up screw has been loosened.

3. The hydraulic buffer hinge according to claim 1, wherein said hydraulic buffer is comprised of a cylindrical container having an opening covered with a ring-shaped cap and connected to said cylindrical casing, a piston supported on a spring inside said container to move a piston rod between a forward stroke and a return stroke, said cylindrical container being filled with a hydraulic oil and divided by said piston into a front chamber and a rear chamber, said piston rod having a front end extending out of said ring-shaped cap, said piston having a guiding groove on a peripheral wall thereof for passing said hydraulic oil between said front and rear chambers, and an one-way oil passage hole for passing said hydraulic oil from said rear chamber to said front chamber, said hydraulic oil being squeezed by said piston to flow from said front chamber to said rear chamber through said guiding groove and said one-way oil passage hole upon releasing of said stop plate from said piston rod during the forward stroke, and to flow from said rear chamber to said front chamber through said guiding groove during the return stroke.

4. The hydraulic buffer hinge according to claim 3, wherein said container includes a female screw secured to the outside thereof and through which an adjusting screw is threaded and inserted in said guiding groove to control the flow rate of the hydraulic oil passed therethrough.

5. The hydraulic buffer hinge according to claim 1, wherein said locating mechanism includes a stop element inserted through a through hole on said lower bush, and a spring plate fastened to said lower bush by a screw and covered over said stop element, said locating mechanism including the stop element having a bottom end extending out of said lower bush and engaged against said lower swinging plate to maintain said lower swinging plate at a location spaced from said mounting plate.

* * * * *

UNITED STATES PATENT AND TRADEMARK OFFICE

CERTIFICATE OF CORRECTION

PATENT NO. : 5,383,253

DATED : January 24, 1995

INVENTOR(S) : Yeon-Yu LIU

It is certified that error appears in the above-indentified patent and that said Letters Patent is hereby corrected as shown below:

On the title page:
Items [19] and [76], please change the last name of the inventor to --LIU--.

Signed and Sealed this

Thirteenth Day of June, 1995

*Attest:*

BRUCE LEHMAN

*Attesting Officer*

*Commissioner of Patents and Trademarks*

--